US011802354B2

(12) United States Patent
Fernando et al.

(10) Patent No.: US 11,802,354 B2
(45) Date of Patent: Oct. 31, 2023

(54) FIBRE SPREADING

(71) Applicant: Gerard Fernando, Birmingham (GB)

(72) Inventors: Gerard Fernando, Birmingham (GB); Venkata Machavaram, Birmingham (GB)

( * ) Notice: Subject to any disclaimer, the term of this patent is extended or adjusted under 35 U.S.C. 154(b) by 191 days.

(21) Appl. No.: 17/343,217

(22) Filed: Jun. 9, 2021

(65) Prior Publication Data

US 2021/0340697 A1 Nov. 4, 2021

Related U.S. Application Data

(63) Continuation of application No. 16/307,997, filed as application No. PCT/GB2017/051617 on Jun. 5, 2017, now Pat. No. 11,060,213.

(30) Foreign Application Priority Data

Jun. 7, 2016 (GB) ..... 1609919

(51) Int. Cl.
*D02J 1/18* (2006.01)
*B65H 51/005* (2006.01)
(Continued)

(52) U.S. Cl.
CPC ..... *D02J 1/18* (2013.01); *B65H 51/005* (2013.01); *B65H 59/26* (2013.01); *D02J 1/20* (2013.01)

(58) Field of Classification Search
CPC ..... D02J 1/18; D02J 1/20; D02J 1/02; D02J 1/06; D02J 3/02; D02J 3/04; D02J 3/06;
(Continued)

(56) References Cited

U.S. PATENT DOCUMENTS 2,244,203 A 6/1941 Kern
3,156,016 A * 11/1964 Dunlap ..... D02J 1/18 28/282
(Continued)

FOREIGN PATENT DOCUMENTS

CN 203462223 3/2014
CN 105121720 5/2017
(Continued)

OTHER PUBLICATIONS

European Search Report; dated Mar. 13, 2020, in a corresponding EP Divisional fling.
(Continued)

*Primary Examiner* — Amy Vanatta
(74) *Attorney, Agent, or Firm* — Renner, Kenner, Greive, Bobak, Taylor & Weber

(57) ABSTRACT

A method of spreading fibres, the method comprises providing a continuous fibre bundle having an initial width $W_a$ and causing the fibre bundle to run, in a running direction, through tensioning means and past or through fluid flow means, the tensioning means intermittently varying the tension in the fibre bundle and the fluid flow means producing a fluid flow through the fibre bundle as the tension varies in the fibre bundle, whereby the width of the fibre bundle increases to a spread width $W_b$. Apparatus (1) is also disclosed, which apparatus (1) comprises a tensioning means (3) to intermittently vary the tension in the fibre bundle (2) and a fluid flow means (4) for producing a flow of fluid through the bundle (2).

20 Claims, 7 Drawing Sheets

(51) Int. Cl.
*B65H 59/26* (2006.01)
*D02J 1/20* (2006.01)

(58) Field of Classification Search
CPC ..... B65H 51/005; B65H 59/26; B65H 2701/312; B65H 2701/314; D01D 11/02; D06C 3/06; D06C 11/00; D02G 1/008
USPC ..... 28/282; 19/66 T
See application file for complete search history.

(56) References Cited

U.S. PATENT DOCUMENTS 3,255,506 A * 6/1966 Fritz ..... B01D 39/18 28/282
3,421,185 A * 1/1969 Abdel-Moniem Gorrafa ..... D01H 5/24 28/282
3,440,689 A * 4/1969 Ishikura ..... D01G 1/10 28/282
3,708,832 A 1/1973 Lohrke
3,808,639 A 5/1974 Tautvaisas
3,874,030 A 4/1975 Knight
4,010,915 A * 3/1977 Strutz ..... B65H 59/10 28/186
4,509,452 A * 4/1985 Pryor ..... A24D 3/022 28/282
4,959,895 A * 10/1990 Sager ..... B65H 51/005 28/282
6,032,342 A * 3/2000 Kawabe ..... D04H 1/48 226/97.4
2003/0057585 A1* 3/2003 Tanaka ..... B29B 15/122 264/103
2006/0053593 A1* 3/2006 Gombash, Jr. ..... D02J 1/18 19/66 T
2014/0069073 A1* 3/2014 Dominguez ..... D02J 1/18 57/2.3
2016/0083873 A1 3/2016 Tomoda et al.
2018/0119317 A1* 5/2018 Ootsubo ..... D01D 11/02
2018/0313027 A1* 11/2018 Horimoto ..... D06M 15/55

FOREIGN PATENT DOCUMENTS

| | | |
|---|---|---|
| DE | 0715801 | 1/1942 |
| EP | 0455149 | 11/1991 |
| EP | 0393420 | 10/1993 |
| EP | 1172191 | 1/2002 |
| EP | 0837162 | 2/2004 |
| EP | 2987896 | 2/2016 |
| JP | 2001288639 | 10/2001 |
| JP | 2001080056 | 4/2003 |
| JP | 4631663 | 11/2009 |
| JP | 2002030538 | 11/2009 |
| JP | 2014101607 | 6/2014 |
| JP | 2001288639 | 3/2019 |
| JP | 2007009357 | 3/2019 |
| JP | 2013076193 | 3/2019 |
| JP | 2014101607 | 3/2019 |
| WO | 9955943 | 11/1999 |
| WO | 2005002819 | 1/2005 |

OTHER PUBLICATIONS

The design and optimisation of a rig to enable the lateral spreading of fibre bundles; MS Irfan et al; Journal of Composite Materials, vol. 48, No. 15; Jun. 4, 2013; pp. 1813-1831.

* cited by examiner

FIBRE SPREADING

This invention relates generally to fibre spreading. More specifically, although not exclusively, this invention relates to a method of spreading fibres, an apparatus for spreading fibres and a spread fibre sheet. Even more specifically, although not exclusively, this invention relates to a method of spreading glass or carbon fibres, an apparatus for spreading glass or carbon fibres and a spread glass or carbon fibre sheet.

Fibres, such as carbon and glass, are typically sold as a fibre bundle which comprises a plurality of continuous filament fibres held generally parallel to one another by a binder material, e.g. epoxy resin, vinyl ester resin, polyester resin or phenolic resin. The fibre bundle is typically wound around a bobbin for storage and transportation. The fibre bundle commonly comprises a tow of generally parallel filament fibres, some of which may be tangled and/or twisted or otherwise arranged in a non-parallel orientation relative to other filament fibres of the fibre bundle. Commercially available fibre bundles typically contain thousands of filament fibres.

Fibre-reinforced composite materials are commonly manufactured in order to produce articles which combine materials properties of both the fibres and the matrix in which said fibres are retained. For example, it is known to manufacture carbon fibre reinforced sheet in which the matrix is a resin, e.g. an epoxy resin. Such carbon fibre reinforced sheets combine the low specific gravity, high specific tensile strength and high specific elastic modulus of carbon fibres with the flexibility and/or low expense of the resin matrix in order to produce relatively inexpensive articles with relatively high strength to weight ratios.

Fibre-reinforced composite sheets are commonly formed by spreading fibre bundles such that they are relatively wider and thinner (e.g. contain less layering) and then binding the layers together in a matrix material. Typically, the fibre bundles are woven together, or otherwise aligned relative to other fibre bundles, prior to binding by the matrix material. Spreading of the fibre bundles, prior to the formation of composite sheets, beneficially reduces the quantity of said fibre bundles required to form said sheets, with a consequential reduction in their expense and/or makes the spread fibres more homogeneous. Furthermore, by spreading the fibre bundle prior to formation of a composite sheet said formed sheet may be thinner and lighter relative to a sheet formed with non-spread fibre bundles. Yet further, by spreading the fibre bundle in order to form a relatively thinner fibre bundle prior to formation of a composite sheet, the time required to impregnate a matrix material into the fibre bundle is relatively reduced with a consequent reduction in processing expense.

It is particularly beneficial to spread a fibre bundle such that the bundle is relatively wide but also has a relatively homogenous distribution of fibres across its width and a relatively uniform thickness. Ultimately, it may be ideal to spread a fibre bundle such that a monolayer of filament fibres is formed, where the thus spread fibre bundle is free of gaps between filament fibres across its width. However, fibre bundles containing relatively greater numbers of filament fibres tend to be more tangled and/or twisted or otherwise more disorderly arranged than are fibre bundles containing lesser numbers of filament fibres. Consequently, whilst the benefit of spreading fibre bundles containing relatively greater quantities of filament fibres is more significant (via achievement of a greater spread width), the difficulty of said spreading is also greater due to the tangling meandering fibres, and/or twisting. Moreover, it is important when spreading a fibre bundle to minimise damage to the filament fibres of said fibre bundle and furthermore to retain, so far as possible, the mechanical properties of the filament fibres. It is additionally important (particularly when processing glass or carbon fibre bundles) to ensure that generation of air-borne fibre waste matter is minimised or prevented in order to provide a safe environment surrounding fibre spreading machinery.

Prior art methods and apparatus for spreading fibre bundles have been found to produce spread fibre bundles which are spread to an insufficient width relative to their starting width, are not thin enough relative to their starting thickness, are not of uniform thickness across their spread width, contain gaps across their spread width and/or contain filament fibres having relatively reduced physical and/or mechanical properties. For example, WO2005/002819 discloses a method of spreading a fibre bundle which provides at maximum an eight times increase in the width of the bundle which is further reduced relatively when plural spread bundles are combined.

It is therefore a first non-exclusive object of the invention to provide a method and apparatus for spreading fibres which at least partially mitigates one or more of the above issues. It is a further non-exclusive object of the invention to provide a method and apparatus for spreading fibres which produces more widely spread fibres and/or more uniformly spread fibres.

Accordingly, a first aspect of the invention provides a method of spreading fibres, the method comprising providing a continuous fibre bundle having a width $W_a$ and causing the fibre bundle to run, in a running direction, across or through tensioning means arranged to intermittently increase the tension in the fibre bundle and to cause (or causing) the fibre bundle to run through, e.g. to be brought into proximity and away from, fluid flow means as the tension in the fibre bundle falls and rises respectively whereby the width $W_b$ of the fibre bundle increases.

A second aspect of the invention provides an apparatus for spreading fibres, the apparatus comprising an upstream tensioning means and a downstream fluid flow means, the tensioning means being arranged intermittently to increase and decrease the tension in a continuous fibre bundle running therethrough and to cause said fibre bundle to be brought into proximity and away from said fluid flow means thereby to increase the width of the fibre bundle.

The fibre bundle being brought into proximity with and away from the fluid flow means may comprise producing a variable fluid flow through the fibre bundle.

A further aspect of the invention provides a method of spreading fibres, the method comprising providing a continuous fibre bundle having an initial width $W_a$ and causing the fibre bundle to run, in a running direction, through tensioning means and past or through fluid flow means, the tensioning means intermittently varying the tension in the fibre bundle and the fluid flow means producing a variable fluid flow through the fibre bundle as the tension varies in the fibre bundle, whereby the width of the fibre bundle increases to a spread width $W_b$.

Most preferably the fluid flow means is located downstream of the tensioning means (for example partially or entirely downstream of the tensioning means).

The fibre bundle may be caused to run through said fluid flow means and may be confined within a housing defining the fluid flow means.

A yet further aspect of the invention provides an apparatus for spreading fibres, the apparatus comprising a tensioning means and a fluid flow means which is downstream of the tensioning means, the tensioning means being arranged to intermittently increase the tension in a continuous fibre bundle running therethrough, the fluid flow means being arranged to produce a variable fluid flow through the fibre bundle as the tension varies in said bundle running therethrough, thereby to increase the width of the fibre bundle from an initial width $W_a$ to a spread width $W_b$.

The spread width $W_b$ may have a ratio to the initial width $W_a$ of greater than 5:1, for example between about 6:1 and 20:1, for example between about 6:1 and 15:1, say between about 6:1 and 12:1, e.g. between about 6:1 and 12:1, preferably between about 8:1 and 12:1.

Causing the fibre bundle to run may comprise causing the fibre bundle to be dispensed or hauled-off, e.g. from a dispenser or supply bobbin and/or dispensing or pay-out system. The fibre bundle may be supplied or suppliable from a dispenser or supply bobbin and/or dispensing or pay-out system. The dispenser or supply bobbin and/or dispensing or pay-out system may be driven, e.g. rotationally driven. The dispenser or supply bobbin and/or dispensing or pay-out system may be configured to cause or allow the fibre bundle to run, in a running direction, through the apparatus.

The fibre bundle preferably comprises plural continuous filament fibres. The fibre bundle may comprise carbon fibres and/or glass fibres and/or ceramic fibres and/or aromatic polyamide fibres and/or any other suitable fibres. Each individual filament fibre may have a diameter, for example which may be between about 2 μm ($2\times10^{-6}$ m) and 50 μm, say between about 4 μm and 30 μm, e.g. between about 5 μm and 25 μm. The fibre bundle may comprise between about 100 and 50,000 filament fibres, say between about 500 and 50,000 filament fibres, for example between about 1,000 and 50,000 filament fibres. The fibre bundle may comprise a binder or binder resin, e.g. configured to bind together the filament fibres therein. The binder or binder resin may comprise epoxy resin, vinyl ester resin, polyester resin or phenolic resin or any other suitable material. For example, a fibre bundle of 12,000, 7 μm diameter fibres will have a theoretical 'monolayer' width of 84 mm.

The fibre bundle may have an average initial thickness $T_a$ (e.g. orthogonal to its initial width $W_a$). The spread fibre bundle may have an average spread thickness Tb (e.g. orthogonal to its spread width $W_b$). The average spread thickness Tb of the fibre bundle may have a ratio to the diameter of individual filament fibres of between about 4:1 and 1:1, for example between about 3:1 and 1:1, e.g. between about 2:1 and 1:1, say between about 1.5 and 1:1.

The tensioning means may translate, e.g. at least partially translate, in the running direction of the fibre bundle. The tensioning means may be arranged to translate, in use, in the running direction of the fibre bundle running therethrough. The tensioning means may comprise a tension release system. Preferably the tensioning means comprises one or more moving or movable elements, e.g. configured to move the fibre bundle and thereby intermittently increase and decrease tension therein. The one or more moving or movable elements may be configured or configurable to contact the fibre bundle, e.g. thereby to intermittently bias the fibre bundle toward an increased tension and/or toward a decreased tension. The one or more moving or movable elements may preferably be rotating or rotatable.

The one or more moving or movable elements may comprise one or more tensioning rollers. The one or more tensioning rollers may be moving or movable so as to intermittently increase and decease tension in the fibre bundle. At least one of the one or more tensioning rollers may be moving or movable in order to intermittently contact the fibre bundle. The one or more tensioning rollers may be moving or movable such that a fibre bundle path length through the tensioning means, e.g. between tensioning rollers therein, intermittently increases and decreases. The, one, some or each tensioning roller may rotate or be rotatable about its or their central axis or axes.

Most preferably there is more than one tensioning roller. Some or all of the tensioning rollers may be moving or movable in order to intermittently contact the fibre bundle. Where more than one tensioning roller is provided some or all of said tensioning rollers may be moving or movable such that a fibre bundle path length between the tensioning roller furthest downstream and the tensioning roller furthest upstream intermittently increases and decreases.

The, one, some or each tensioning roller may comprise a contact surface, for example for contacting the fibre bundle. The contact surface may be smooth, e.g. substantially smooth. Additionally or alternatively the contact surface may be rough and/or may comprise a plurality of projections. The contact surface may be cylindrical or may be of entasis or entosis shape.

The tensioning means may further comprise one or more tensioning creels or hubs. The or each tensioning creel or hub may comprise one or more of the tensioning rollers (where provided). The, one, some or each tensioning creel or hub may rotate or be rotatable about a central axis, e.g. about its or their central axis or axes.

The, one, some or each tensioning roller may move or be movable (e.g. may rotate or be rotatable) about a or the central axis or axes of the one or more tensioning creel or hub. The, one, some or each tensioning roller may be freely moving or movable (e.g. may be freely rotating or rotatabe) about a or the central axis or axes of the one or more tensioning creel or hub. The, one, some or each tensioning roller may be driven or drivable to move (e.g. rotate) about a, or, the central axis or axes of the one or more tensioning creel or hub.

The central axis of the, one, some or each tensioning roller may be spaced from a or the central axis or axes of the tensioning creel(s) or hub(s). The central axis or axes of the, one, some or each tensioning roller may be spaced from the central axis or axes of the, one, some or each tensioning creel or hub. Preferably more than one tensioning creel or hub is provided. Where more than one tensioning creel or hub is provided, one, some or all of the tensioning creel(s) or hub(s) may comprise one or more tensioning rollers. Where the, one, some or each tensioning creel or hub comprises more than one tensioning roller some or each of the central axes of the tensioning rollers may be spaced from the central axis or axes of the creel(s) or hub(s) by a similar or a different distance.

The, one, some or each tensioning creel or hub may comprise first and second tensioning rollers, e.g. which may be freely rotating or rotatable about their central axes. The spacing of the first tensioning roller, e.g. of the central axis of the first tensioning roller, from the rotational axis of the or each tensioning creel or hub may be by a similar or different distance to the spacing of the second tensioning roller, e.g. of the central axis of the second tensioning roller, from the central axis of the or each tensioning creel or hub. The central axis of the, or, each tensioning creel or hub may be located in a plane defined by the central axes of the first and second tensioning rollers. Alternatively, the central axis of the or each tensioning creel or hub may be located out of a plane defined by the central axes of the first and second tensioning rollers.

Where more than one tensioning creel or hub is provided each may be rotating or rotatable in the same direction relative to a running direction of the fibre bundle. Alternatively, one or more tensioning reel or hub may be rotating or rotatable in a different direction from one or more other tensioning creel(s) or hub(s), relative to a running direction of the fibre bundle.

The tensioning means and/or apparatus may further comprise a take up or collection or haul-off reel, e.g. configured to take up or collect spread fibre bundle. The take up or collection or haul-off reel may be driven, e.g. rotationally driven. Preferably, the take up or collection or haul-off reel is configured to cause the fibre bundle to run, in a running direction, through the apparatus, e.g. through the tensioning means and/or the fluid flow means.

The fluid flow means may be configured or configurable to intermittently bend the fibre bundle (e.g. in or at the fluid flow means), for example thereby to spread the fibre bundle. The fluid flow means may define a flow path in the direction of which the fibre bundle reciprocally moves as the fibre bundle translates in the running direction. The fibre bundle may be caused or allowed to move, e.g. reciprocally move, within the flow path by the varying of tension within said fibre bundle. The pressure and/or velocity of the fluid flow may vary along the flow path. Decrease of tension in the fibre bundle (e.g. via action of the tensioning means) may cause or allow the fibre bundle to move to or toward a lesser pressure and/or greater velocity of fluid flow within the flow path. Increase of tension in the fibre bundle (e.g. via action of the tensioning means) may cause or allow the fibre bundle to move to or toward a greater pressure and/or lesser velocity of fluid flow within the flow path. The tensioning means may be arranged to cause or allow the fibre bundle to move, e.g. reciprocally move, within the, or, a flow path defined by the fluid flow means. The tensioning means may be arranged to cause or allow the fibre bundle to reciprocally move into and out of a region of relatively greater velocity and/or relatively lesser pressure of the fluid flow. An increased width of the fibre bundle may be retained or maintained within the flow path by use of a retention member.

The fluid flow means may comprise an active zone and a passive zone, e.g. where proximity to the active zone causes the width of the fibre bundle to spread. The tensioning means may be arranged to cause or allow the fibre bundle, e.g. a portion of the fibre bundle, to move from the passive zone to or toward the active zone. The tensioning means may be arranged to cause or allow the fibre bundle, e.g. a portion of the fibre bundle, to move from the active zone to or toward the passive zone. The tensioning means may be arranged to cause or allow the fibre bundle to move, e.g. repeatedly move, from the active zone to or toward the passive zone and back again.

The fluid flow means and/or tensioning means may comprise a retention member, e.g. which may be configured to retain or maintain (e.g. substantially retain or maintain) a spread width of the fibre bundle.

Preferably the fluid flow means comprises a housing. In an embodiment a retention member is located within the housing. The retention member may be able to reciprocate within the housing, for example in a direction orthogonal to the running direction of the fibre bundle. The retention member may be free to move or may be driven. The retention member may be retain the fibre bundle within the housing as it runs in the running direction.

The fluid flow may comprise air, water and/or any other suitable fluid or combination of fluids. The fluid flow may be driven by a negative or a positive pressure. Preferably the fluid flow is driven by a negative pressure. The fluid flow may have a lower pressure in the passive zone than in the active zone. The fluid flow may have a greater velocity in the active zone than in the passive zone.

The fluid flow means may comprise a fluid flow path, e.g. orthogonal or substantially orthogonal to the running direction of the fibre bundle. Alternatively the fluid flow path may define an acute angle with respect to the running direction of the fibre bundle. The fluid flow means may comprise a housing, e.g. which comprises a fluid inlet in fluid communication with a fluid outlet. The fluid flow path may pass through the housing, e.g. through the fluid inlet to and/or through the fluid outlet. The housing may comprise the passive zone and/or the active zone (where provided). The passive zone may be relatively nearer to the fluid inlet than is the active zone. The active zone may be relatively nearer to the fluid outlet than is the passive zone. The housing may further comprise an opening or an open end and a lid, for example configured to provide a partial seal on the housing. The lid may be configured to cover between about 50% and 90% of the opening or open end of the housing, say between about 50% and 80%, for example between about 50% and 70%. The fluid flow means or housing may comprise a taper or narrowing, e.g. between the fluid inlet and fluid outlet. The active zone, where provided, may be located at least partially within the taper or narrowing. The passive zone, where provided, may be located entirely outside of the taper or narrowing. The passive zone may be located, e.g. at least partially located, inside of the taper or narrowing. Where the active zone and passive zone are both located, e.g. at least partially located, within the taper or narrowing, the active zone may be located within a relatively narrower or less wide part of the taper or narrowing than is the passive zone.

The fluid flow means may comprise two side walls and two end walls. The side walls are opposite one another and may be substantially parallel. The end walls are also opposite one another and may be substantially parallel. Each end wall comprises an inner surface. In embodiments, one or both of the end walls may taper linearly (i.e. rectilinear) or comprise a curved inner surface (i.e. curvilinear), the curved inner surface being concave. The curved inner surface may taper towards the fluid flow outlet. In embodiments, an end wall comprising the curved inner surface may be opposite a substantially vertical end wall. The flow path is defined by the fluid flow means, the shape of which determines the pressure and/or velocity of fluid flow at any given point in the flow path. The curved inner surface of the end wall provides an advantageous ratio of the size of the fluid flow inlet to the fluid flow outlet. As a consequence, the fluid flow in the flow path has a relatively lesser pressure and greater velocity toward the fluid flow outlet, and the fluid flow in the flow path has a relatively greater pressure and lesser velocity toward the fluid flow inlet. A negative gradient for pressure and a positive gradient for velocity exist between in the flow path between the fluid flow inlet and the fluid flow outlet. Consequently, moving a portion of the fibre bundle toward the fluid flow outlet, as a result of varying the tension in the fibre bundle by the tensioning means, moves that part of the fibre bundle into fluid flow in the flow path having relatively greater velocity and/or lesser pressure. Advantageously, this variable fluid flow through the fibre bundle as the tensioning means varies the tension in the fibre bundle produces an optimised spread width $W_b$ within the fibre bundle. In embodiments the cross sectional area may reduce by over 50, 60 or 70%, for example from 50 to 90%, for example from 60 to 85%.

The fluid flow means may be located adjacent the take up or collection or haul-off reel (where provided). Where the fluid flow means comprises a housing the housing may further comprise an end wall configured to enable close positioning of the housing to the take up or collection or haul-off reel. The end wall may comprise a curved outer surface, at least in part, for example where the curve is configured to cooperate with a curved outer surface of the take up or collection or haul-off reel.

In the method and/or apparatus the fibre bundle may be caused to run through said fluid flow means and may be confined within a housing defining the fluid flow means. In a preferred embodiment the housing comprises a retainer under which the fibre bundle runs, the retainer preferably acting to ensure the fibre bundle remains within the confines of the housing as the fibre bundle translates in the running direction. In an embodiment the retainer rises and falls as the tension increases and decreases. In an embodiment, as the tension decreases the fibre bundle moves into the housing, as the tension increases the fibre bundle moves away from or in a direction away from the housing.

For the avoidance of doubt, any of the features described herein apply equally to any aspect of the invention. Additionally, the method may comprise any actions or steps necessary in order to utilize the described features of the apparatus.

A further aspect of the invention provides a method of spreading fibres, the method comprising providing a continuous fibre bundle having an initial width $W_a$ and causing the fibre bundle to run, in a running direction, through tensioning means and contact means, the tension means intermittently varying the tension in the fibre bundle and the contact means comprises a microfibre fabric arranged to contact the fibre bundle, whereby the width of the fibre bundle increases to a spread width $W_b$.

A yet further aspect of the invention provides an apparatus for spreading fibres, the apparatus comprising a tensioning means and a contact means, the tensioning means being arranged to intermittently vary the tension in a continuous fibre bundle running therethrough and the contact means comprising a microfibre fabric arranged to contact the fibre bundle thereby to increase the width of the fibre bundle from an initial width $W_a$ to a spread width $W_b$.

Where the tensioning means comprises one or more tensioning rollers, the microfibre fabric may be located on and/or around the, one, some or each of the one or more tensioning rollers, for example on and/or around an outer surface thereof.

The microfibre fabric may comprise a main body with a plurality of protruding fibres projecting therefrom, e.g. substantially orthogonally therefrom. The protruding fibres may be generally hook shaped, e.g. may comprise a curved portion at or toward their free end. The microfibre fabric may comprise plural bundles of protruding fibres. The microfibre fabric may comprise a nap, for example the protruding fibres may be oriented in a similar direction (e.g. the curved portion of each protruding fibre may be oriented in a similar direction). The microfibre fabric may comprise a nap arranged in a direction opposite, e.g. substantially opposite, to the running direction of the fibre bundle. The microfibre fabric may be oriented, for example on and/or around the, one, some or each tensioning roller (where provided), such that the nap of the microfibre fabric (or a portion thereof) is facing a direction opposite, e.g. substantially opposite, to the running direction of the fibre bundle.

The apparatus and/or the tensioning means may further comprise a binder breaker means configured to break or loosen a binder in and/or on the fibre bundle (where said binder is provided). The binder breaker means may define a tortuous pathway through which the fibre bundle runs or is configured to run. The tortuous pathway may comprise a series of tension rolls, for example which may rotate freely about their rotational axes. The binder breaker means may further comprise an orientation or guide element, for example defining an orientation or guide channel. The orientation or guide channel may be located and/or oriented in order to (at least partially) define a running direction of the fibre bundle supplied from a supply bobbin and/or pay-out system (where provided).

The apparatus and/or the tensioning means may further comprise a tensioner, for example downstream of the binder breaker means (where provided) and/or upstream of the one or more tensioning rollers (where provided). The tensioner may be configured to bias (e.g. to resiliently bias) the fibre bundle, for example toward a direction generally orthogonal to its running direction.

The fibre bundle width may be restricted after the fibre bundle has run through the tensioning means. The apparatus may further comprise an accumulator, e.g. located downstream of the tensioning means and/or upstream of the take up or collection or haul-off reel (where provided). The accumulator may be configured or configurable to restrict or reduce or gather the width of the fibre bundle, for example when the fibre bundle runs therethrough. The accumulator may comprise a first constriction, e.g. through which the fibre bundle is configured to run. The first constriction may be configured or configurable to restrict or reduce or gather the width of the fibre bundle, for example when the fibre bundle runs therethrough. The accumulator may further comprise a second constriction, e.g. configured to further restrict or reduce or gather the width of the fibre bundle, for example when the fibre bundle runs therethrough. The first constriction may be spaced from the second constriction, e.g. along the running direction of the fibre bundle. The accumulator may comprise a tensioning pin or arm between the first constriction and the second constriction, for example where the tensioning arm may be configured or configurable to maintain (e.g. to substantially maintain) or retain a tension in the fibre bundle (for example as generated by the tensioning means).

The apparatus may further comprise measuring means, for example downstream of the tensioning means and/or downstream of the fluid flow means and/or downstream of the contact means (where provided). The measuring means may be configured to measure the fibre bundle, e.g. to measure one or more parameter thereof. The one or more parameter may comprise the width and the thickness of the fibre bundle. The measuring means may comprise one or more measurement scales. The measuring means may comprise plural measuring apparatus. At least one of the measurement apparatus may be disposed adjacent the fibre bundle and/or transverse a running direction thereof.

A further aspect of the invention provides a spread fibre bundle spread by the above described method or apparatus.

A further aspect of the invention provides a sheet comprising one or more spread fibre bundles spread by the above described method or apparatus. The sheet may further comprise a binding matrix, e.g. a binding resin.

Within the scope of this application it is expressly envisaged that the various aspects, embodiments, examples and alternatives set out in the preceding paragraphs, in the claims and/or in the following description and drawings, and in particular the individual features thereof, may be taken independently or in any combination. Features described in connection with one aspect or embodiment of the invention are applicable to all aspects or embodiments, unless such features are incompatible. For example, the microfiber fabric could be used in apparatus/methods where a fluid flow means is provided.

Embodiments of the invention will now be described by way of example only with reference to the accompanying drawings in which.

Figure 1:
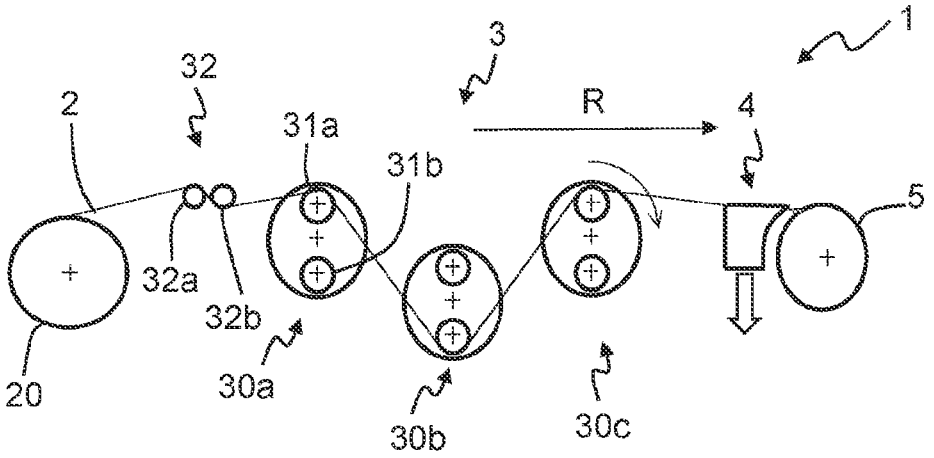
FIG. 1 is a side view of an apparatus according to a first embodiment of the invention.
Figure 2:
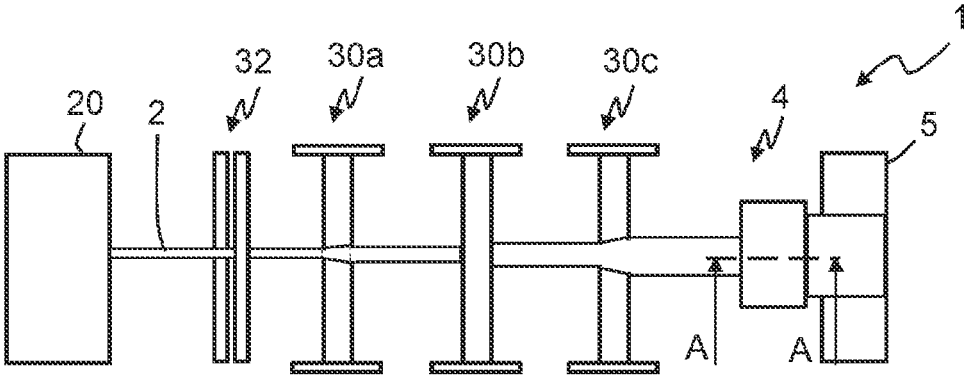
FIG. 2 is a plan view of the apparatus of FIG. 1.

Referring now to FIGS. 1 and 2, there is shown an apparatus 1 for spreading fibres according to a first embodiment of the invention, the apparatus 1 comprising a bobbin 20 for supply of a continuous fibre bundle 2, a tensioning apparatus 3 and a fluid flow apparatus 4.

The fibre bundle 2 comprises, in and embodiment, plural continuous carbon fibres held together by a binding agent. The fibre bundle 2 is supplied from the supply bobbin 20 and runs through the apparatus 1 to a take up reel 5, as will be described further below.

The tensioning apparatus 3 comprises first, second and third tensioning creels 30*a*, 30*b*, 30*c* each of which comprise first and second tensioning rollers 31*a*, 31*b*. The tensioning apparatus 3 also comprises a damping mechanism 32, located upstream of the tensioning creels 30*a*, 30*b*, 30*c*, which includes a pair of freely rotatable damping rollers 32*a*, 32*b*. Rotational axes (indicated by a +) through the supply bobbin 20, each of the tensioning creels 30*a*, 30*b*, 30*c*, each of the tensioning rollers 31*a*, 31*b*, the damping rollers 32*a*, 32*b* and the take up reel 5 are parallel to one another and thereby orthogonal to the running direction R of the fibre bundle 2.

The first, second and third tensioning creels 30*a*, 30*b*, 30*c* are each connected to a motor (not shown) operable to independently drive rotation of each of the tensioning creels 30*a*, 30*b*, 30*c*. The first and second tensioning rollers 31*a*, 31*b* of each of the tensioning creels 30*a*, 30*b*, 30*c* are freely rotatable and are not driven. The third tensioning creel 30*c* is downstream of the first tensioning creel 30*a* with the second tensioning creel 30*b* located therebetween (in the running direction R).

Figure 3:
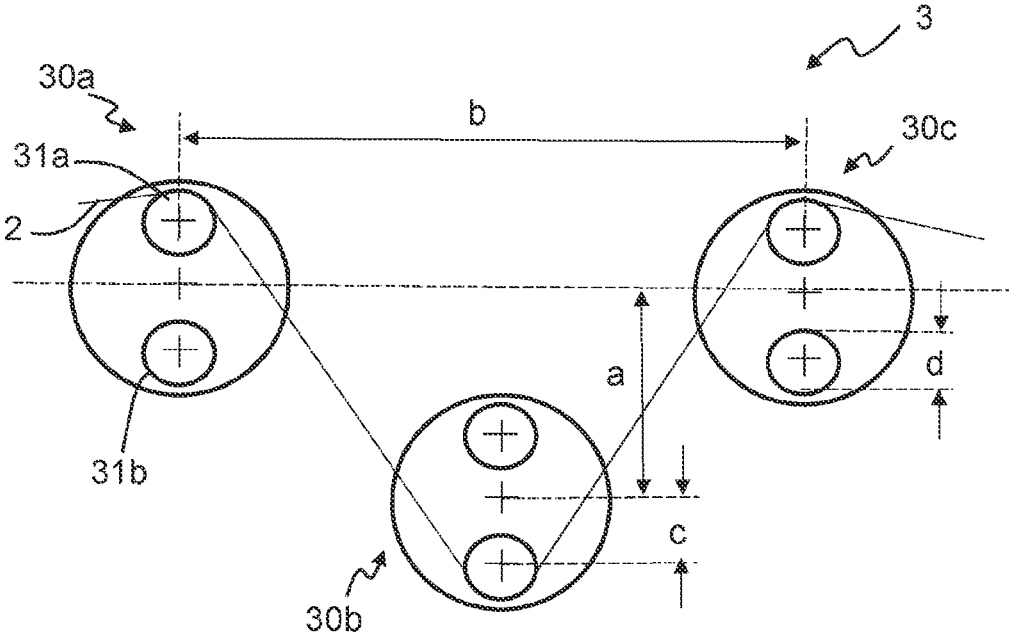
FIG. 3 is a side view of components of the apparatus of FIG. 1 in a first condition.

Referring now to FIG. 3, there is shown a view of the tensioning creels 30*a*, 30*b*, 30*c* of the apparatus 1 shown in FIG. 1. The tensioning rollers 31*a*, 31*b*, which are formed from acetal and have a smooth major circumferential surface, are cylindrical and each have a diameter 'd'. The rotational axis of the second tensioning creel 30*b* is offset by a distance 'a' from a plane 'P' defined by the rotational axes of the first and third tensioning creels 30*a*, 30*c*. The rotational axis of the first tensioning creel 30*a* is spaced from the rotational axis of the third tensioning creel 30*c* by a distance 'b'. The rotational axis of the second tensioning creel 30*b* is located an equal distance between the rotational axes of the first and third tensioning creels 30*a*, 30*c*. The first and second tensioning rollers 31*a*, 31*b* are located toward the periphery of the first tensioning creel 30*a*. The rotational axes of the first and second tensioning rollers 31*a*, 31*b* are located in the first tensioning creel 30*a* such that the rotational axis thereof is located in a plane defined by the rotational axes of the first and second tensioning rollers 31*a*, 31*b*. The rotational axes of the first and second tensioning rollers 31*a*, 31*b* are each spaced by a distance 'c' from the rotational axis of the first tensioning creel 30*a*. Although only the arrangement of the first and second tensioning rollers 31*a*, 31*b* on the first tensioning creel 30*a* is described it will be appreciated that first and second tensioning rollers 31*a*, 31*b* are similarly arranged on the second and third tensioning creels 30*b*, 30*c*, which will not therefore be described further herein.

The above-described dimensions a, b, c and/or d may be selected in order to suit the specific type of fibre bundle 2 which is to be processed. Without wishing to be bound by any particular theory we believe that increasing the distance between any two points of contact between the fibre bundle 2 and the tensioning rollers 31*a*, 31*b* alters the amount of spreading of the fibre bundle 2. Moreover, increasing the distance between points of contact of the fibre bundle 2 and the tensioning rollers 31*a*, 31*b* beyond a threshold value may result in the spread filaments of the fibre bundle 2 coalescing back together, e.g. de-spreading. The dimensions a, b, c and/or d may be selected, for example, based at least in part on the profile (for example the cross-sectional profile) of a fibre bundle 2 to be processed and/or of the binder content and/or of the filament quantity and/or diameter within said fibre bundle 2.

Figure 4:
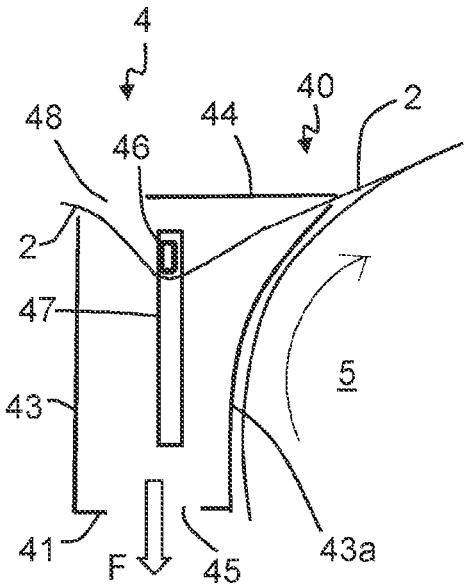
FIG. 4 is a sectional side view taken along the plane indicated by A-A in FIG. 2.
Figure 5:
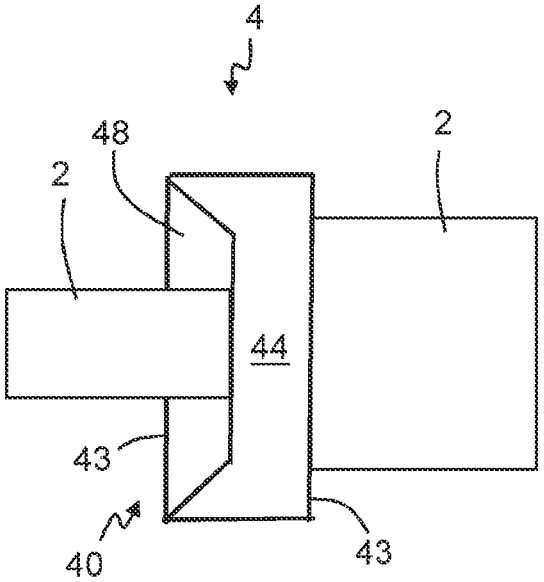
FIG. 5 is a plan view of the component of the apparatus shown in FIG. 4.
Figure 6:
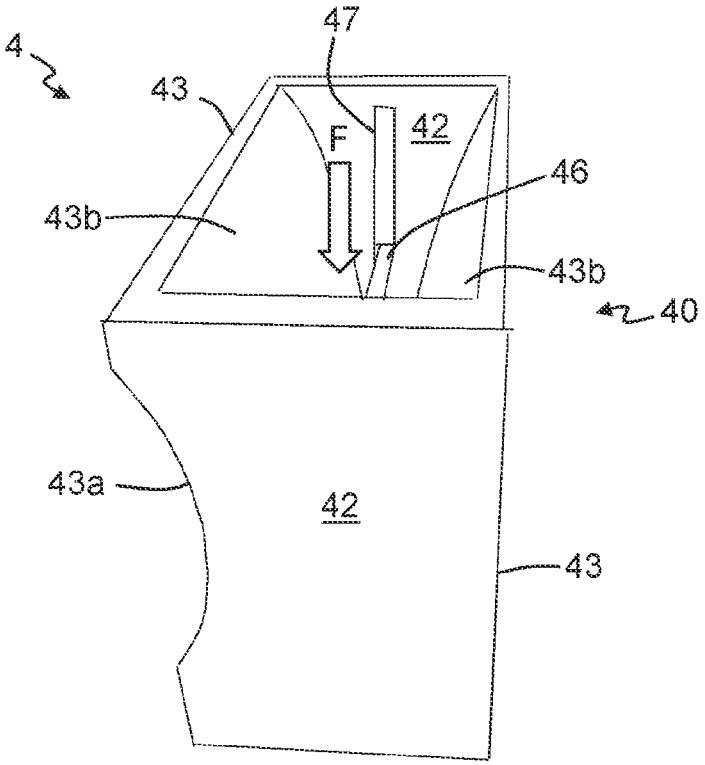
FIG. 6 is a perspective view of the component of the apparatus shown in FIG. 4.

Referring now to FIGS. 4, 5 and 6, there is shown various views of the fluid flow apparatus 4 shown in FIGS. 1 and 2. The fluid flow apparatus 4 includes a housing 40 comprising a base 41, side walls 42, end walls 43 and a lid 44. One of the end walls 43 has a curved outer face 43*a* so that the fluid flow apparatus 4 may be located in close proximity to the take up reel 5. A fluid flow outlet 45 through the base 41 of the housing 40 is fluidly connected to a source of vacuum (not shown). The fluid flow apparatus 4 further includes a retention baton or member 46, fitted at both of its ends into opposed, vertical slots 47 in facing portions of the side walls 42 of the housing 40. The retention baton or member 46 is free to move toward and away from the fluid flow outlet 45 (vertically, in this embodiment) within the slots 47.

The housing 40 has an open top which the lid 44 is configured to partially cover and to provide a partial seal thereagainst, thereby to provide a fluid flow inlet 48. The fluid flow inlet 48 is in fluid communication with the fluid flow outlet 45 thereby defining a fluid flow path F. The pressure and velocity of the fluid flow varies along the flow path F, with a relatively lower pressure and greater velocity toward the fluid flow outlet 45. The lid 44 is substantially flat and comprises a generally rectangular shape in plan with two triangular wings protruding from one side thereof. The lid 44 is configured to permit substantially free and unhindered passage of the fibre bundle 2 as it runs between the side walls 42 of the housing 40 and the lid 44. The inner surface 43*b* of the end walls 43 taper toward the fluid flow outlet 45 (as shown in FIG. 6). Conveniently the inner surface 43*b* of the end walls 43 may be curved from the inlet 48 to the outlet 45 or they may taper linearly. In any case, the cross sectional area of the aperture decreases in the direction of the fluid flow path, from the housing entrance 48. In embodiments the cross sectional area may reduce by over 50, 60 or 70%, for example from 50 to 90%, for example from 60 to 85%.

The take up reel 5 is cylindrical and is connected to a motor (not shown) operable to drive rotation of the take up reel 5. Although the fluid flow apparatus 4 is shown as being spaced from the take up reel 5 in FIGS. 1 and 2 it will be appreciated that this spacing has been provided in order to more clearly show the apparatus 1 and that in practice the fluid flow apparatus 4 may be located directly adjacent the take up reel 5 (e.g. at a minimal distance therefrom).

The apparatus 1 is prepared for use by feeding a free end of the fibre bundle 2 between the damping rollers 32*a*, 32*b* of the damping mechanism 32, over the first tensioning creel 30*a*, under the second tensioning creel 30*b*, over the third tensioning creel 30*c*, into the housing 40 of the fluid flow apparatus 4, under the retention baton or member 46, out of the housing 40 of the fluid flow apparatus 4 and onto the take up reel 5 to which the free end of the fibre bundle 2 is attached.

In use, the fibre bundle 2 is drawn through the apparatus 1 in a running direction R via motor driven rotation of the take up reel 5, whilst the fibre bundle 2 is simultaneously supplied from the supply bobbin 20 via motor (not shown) driven rotation thereof. The fluid flow apparatus 4 is connected to a source of vacuum (not shown) and the third tensioning creel 30*c* is rotated in a clockwise direction (as shown by the arrow in FIG. 1) by a motor (not shown). In this way, at the point of contact between the fibre bundle 2 and a tensioning roller 31*a*, 31*b* of the third tensioning creel 30*c*, the third tensioning creel 30*c* is rotating in the running direction R of the fibre bundle 2.

As the fibre bundle 2 is drawn through the apparatus 1 the first and second tensioning creels 30*a*, 30*b* and the tensioning rollers 31*a*, 31*b* of all of the tensioning creels 30*a*, 30*b*, 30*c* are caused to rotate due to frictional forces between the fibre bundle 2 and the outer surfaces of the tensioning rollers 31*a*, 31*b*. Alternatively, the first and/or second tensioning creels 30*a*, 30*b* may be rotated by a motor (not shown), for example where the first tensioning creel 30*a* is rotated in the same direction as the third tensioning creel 30*c* and/or the second tensioning creel 30*b* is rotated in the opposite direction. Without wishing to be bound by any particular theory we believe that fibre bundles 2 having a relatively higher percentage of binding agent and/or a type of binding agent configured to bind the filament fibres together relatively more strongly may be spread more effectively by driven rotation of more than just the third tensioning creel 30*c*.

Figure 7:
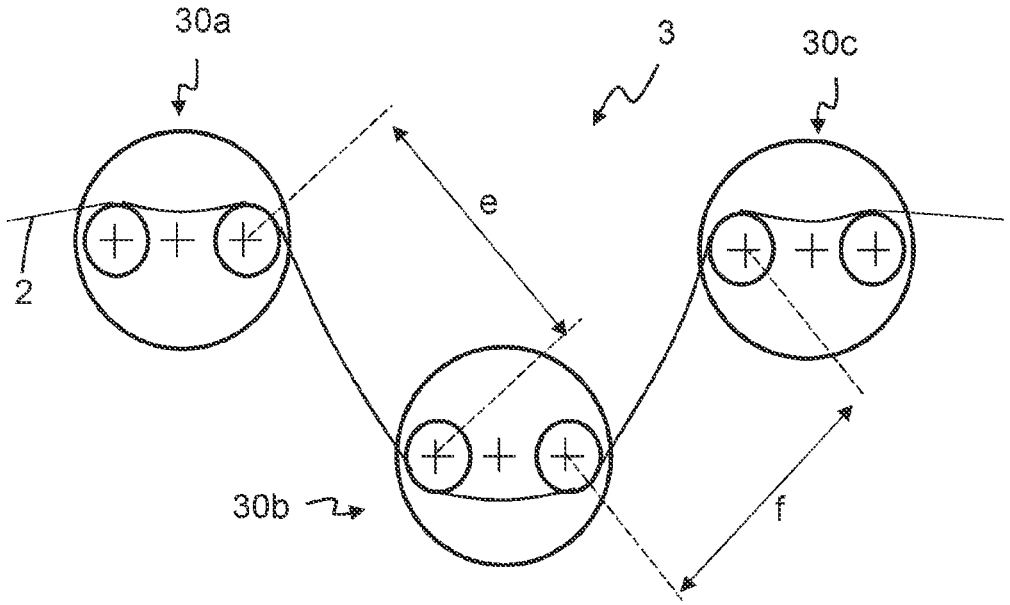
FIG. 7 is a side view of components of the apparatus of FIG. 1 in a second condition.

Referring now to FIG. 7, there is shown a view similar to that of FIG. 3 showing the tensioning creels 30*a*, 30*b*, 30*c* of the apparatus 1. In FIG. 7 each of the tensioning creels 30*a*, 30*b*, 30*c* have rotated by 90 degrees about their rotational axes relative to their orientation as shown in FIG. 3. Therefore, the rotational axes of the tension rollers 31*a*, 31*b* of each tensioning creel 30*a*, 30*b*, 30*c* have also moved, in this case such that the distance e between the rotational axis of the first tension roller 31*a* on the first tensioning creel 30*a* to the rotational axis of the second tensioning roller 31*b* on the second tensioning creel 30*b* is relatively reduced. Additionally, the distance f between the rotational axis of the second tensioning roller 31*b* on the second tensioning creel 30*b* and the first tensioning roller 31*a* on the third tensioning creel 30*c* is relatively reduced.

In the orientation of tensioning rollers 31*a*, 31*b* shown in FIG. 3 the fibre bundle 2 path length through the tensioning apparatus 3 is decreased relative to the orientation of the tensioning rollers 31*a*, 31*b* shown in FIG. 3. Consequently, tension in the fibre bundle 2 relatively increases when the orientation of the tensioning rollers 31*a*, 31*b* moves towards the orientation shown in FIG. 3. The tension in the fibre bundle 2 relatively decreases when the orientation of the tensioning rollers 31*a*, 31*b* moves towards the orientation shown in FIG. 6.

It will be appreciated by one skilled in the art that although only two orientations of tensioning rollers 31*a*, 31*b* are shown in FIGS. 3 and 7 the tensioning rollers 31*a*, 31*b* will, in use, pass through a sequence of continuously changing orientations as each of the tensioning creels 30*a*, 30*b*, 30*c* rotates. Furthermore, the orientations of tensioning rollers 31*a*, 31*b* shown in FIGS. 3 and 7 are for explanatory purposes only and it will be appreciated that, in practice, the tensioning rollers 31*a*, 31*b* may not in fact pass through the specific orientations which have been shown in FIGS. 3 and 7. Even further, it will be appreciated that the tensioning creels 30*a*, 30*b*, 30*c* may not all rotate at the same angular velocity and that therefore, although the tensioning creels 30*a*, 30*b*, 30*c* shown in FIG. 7 are described as having rotated by the same angle (i.e. 90 degrees), relative to the orientation shown in FIG. 3, this is for explanatory purposes only. Indeed, some of the tensioning creels 30*a*, 30*b*, 30*c* may not rotate at all once the apparatus 1 has entered a state of equilibrium, in use. For example, where tensioning creels 30*a* and/or 30*b* are not driven by a motor one or both of said tensioning creels 30*a*, 30*b* may not rotate when the apparatus is in equilibrium.

By way of the above-described rotation of the tensioning creels 30*a*, 30*b*, 30*c* a tension in the fibre bundle 2 is intermittently caused to increase and decrease. Furthermore, the tensioning rollers 31*a*, 31*b* translate in the running direction R of the fibre bundle 2, for example such that the tensioning rollers both carry and tension the fibre bundle at the same time. Advantageously, it has been found that an apparatus provided with tensioning means (e.g. the tensioning rollers 31*a*, 31*b*) which translates in the running direction R of the fibre bundle 2 at least partially mitigates against damage to filament fibres within said fibre bundle 2. Moreover, provision of such a tensioning means which translates in the running direction R of the fibre bundle 2 provides for a greater degree of control over the variance of tension generated in the fibre bundle 2 compared with a system in which the tensioning means does not translate in the running direction R of said fibre bundle 2.

The damping mechanism 32 prevents the fibre bundle 2 from being pulled back upstream towards the supply bobbin 20 whilst also mitigating, at least partially, any vibrations generated in the fibre bundle 2 by the intermittently increased and decreased tension generated therein. The damping mechanism 32 further acts as an orienting guide to the fibre bundle 2 towards the tensioning creels 30*a*, 30*b*, 30*c*.

From the third tensioning creel 30*c* the fibre bundle 2 runs downstream to the fluid flow apparatus 4. When the tension in the fibre bundle 2 is relatively decreased that portion of the fibre bundle 2 within the fluid flow apparatus 4 is caused or allowed to move to or toward a lesser pressure and greater velocity of fluid flow within the flow path F, e.g. due to the effect of the air flow therethrough and/or due to the mass of the retention baton or member 46 acting against the fibre bundle 2. Consequently, the retention baton or member 46 freely moves, in concert with the fibre bundle 2, within the slots 47, toward the fluid flow outlet 45. That portion of the fibre bundle which is within the fluid flow apparatus 4 is spread, e.g. further spread, by the action of the air flowing therethrough and thereagainst.

When the tension in the fibre bundle 2 is relatively increased, via the tensioning apparatus 3, the portion of the fibre bundle 2 within the fluid flow apparatus 4 is caused to move to or toward a greater pressure and lesser velocity of fluid flow within the flow path F, e.g. by being pulled via the relatively increased tension within the fibre bundle 2. The retention baton or member 46 is pulled toward the lid 44, in concert with the fibre bundle 2, within its slots 47. Without wishing to be bound by any particular theory it is believed that frictional forces between the surface of the retention baton or member 46 and the fibre bundle 2 substantially retains the fibre bundle 2 in its further spread width (e.g. at a greater width relative to the fibre bundle 2 width prior to its further spreading in the fluid flow apparatus 4). Furthermore, the retention baton or member 46 provides a smooth surface against and/or under which the fibre bundle 2 runs and/or is tensioned. Moreover, via pivoting against the retention baton or member 46 the fibre bundle 2 may be substantially free of the lid 44 when the fibre bundle 2 is a state of increased tension (via the tensioning apparatus). The retention baton or member 46 may therefore be considered to be a part of either or both the fluid flow apparatus 4 and the tensioning apparatus 3.

The thus spread fibre bundle 2 then exits the fluid flow apparatus 4 and is collected on the take up reel 5, with, in some cases, a continuous release sheet (not shown) formed of paper, located between successive plies of spread fibres.

Without wishing to be bound by any particular theory it is believed that there is a pressure differential within the fluid flow apparatus 4, which may be caused by the shape of the housing 40 and/or the ratio of the sizing of the fluid flow inlet 48 to the fluid flow outlet 45. Consequently, there the air flow in the flow path F has a relatively lesser pressure toward the fluid flow outlet 45. Consequently, the velocity of air flow in the fluid path F within the fluid flow apparatus 4 is relatively greater toward the fluid flow outlet 45. Hence, moving a portion of the fibre bundle 2 toward the fluid flow outlet 45 moves that part of the fibre bundle 2 into air flow in the flow path F having relatively greater velocity. This air flow advantageously acts to bend the filament fibres against which it acts prior to passing between said filament fibres. The passage of the air flow through the fibre bundle 2 acts to generate gaps between the filament fibres, thereby moving individual filament fibres perpendicular to their length (e.g. width wise) and consequently spreading the fibre bundle 2. Use of a fluid flow apparatus 4 advantageously minimises the generation of air-borne fibre bundle 2 waste matter because such matter is instead drawing through the fluid flow apparatus 4.

Test Results

Multiple fibre bundles 2, each comprising 12,000 continuous filament carbon fibres with a diameter of 7 μm each, bound by a binder, were spread using the above-described apparatus 1 and method.

The fibre bundles 2 had an initial width $W_a$ of 7 mm, was spread to an intermediate width $W_i$ of 25 mm after running through the tensioning apparatus, before being spread to a final spread width $W_b$ of 70 mm after running through the fluid flow apparatus and being collected on the take up reel 5. The spread width $W_b$ has a ratio to the initial width $W_a$ of 10:1. The fibre bundles 2 have an average spread thickness Tb of 8.4 μm, which has a ratio to the diameter of individual filament fibres of 1.2:1 demonstrating that this simple apparatus is able to achieve a near monolayer spread.

Provision of the fluid flow apparatus 4 downstream of the tensioning apparatus 3 has been found to be particularly beneficial. By running the fibre bundle 2 through the tensioning apparatus 3 prior to the fluid flow apparatus 4 said fibre bundle 2 is at least partially spread before entering the fluid flow apparatus 4. Without wishing to be bound by any particular theory it is believed that the binder in the fibre bundle 2 is at least partially broken and/or removed by passage through the tensioning apparatus 3. Therefore, when the fibre bundle 2 runs through the fluid flow apparatus 4 the fibre bundle 2 is more effectively spread and consequently is spread to a greater width (relative to a condition where the binder had not previously been at least partially broken and/or removed). Furthermore, it is believed that by at least partially pre-spreading the fibre bundle 2 prior to running it through the fluid flow apparatus 4 the effect thereof is enhanced.

Figure 8:
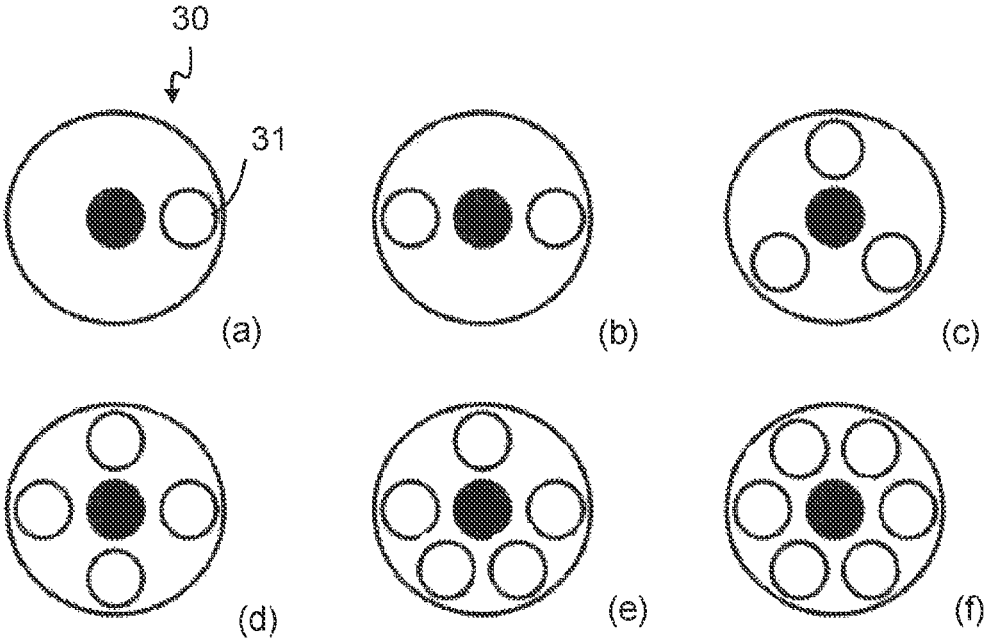
FIG. 8 is a side view of various arrangements of rollers on creels according to the invention.

Referring now to FIG. 8, there are shown various suitable arrangements of tensioning rollers 31 on tensioning creels 30, with one, two, three, four, five or six tensioning rollers 31 provided on each tensioning creel 30. It will be appreciated by one skilled in the art that these arrangements are provided for illustrative purposes only and that the number and/or positioning of the tensioning rollers 31 on the creel 30 may vary from the arrangements shown.

Figure 9:
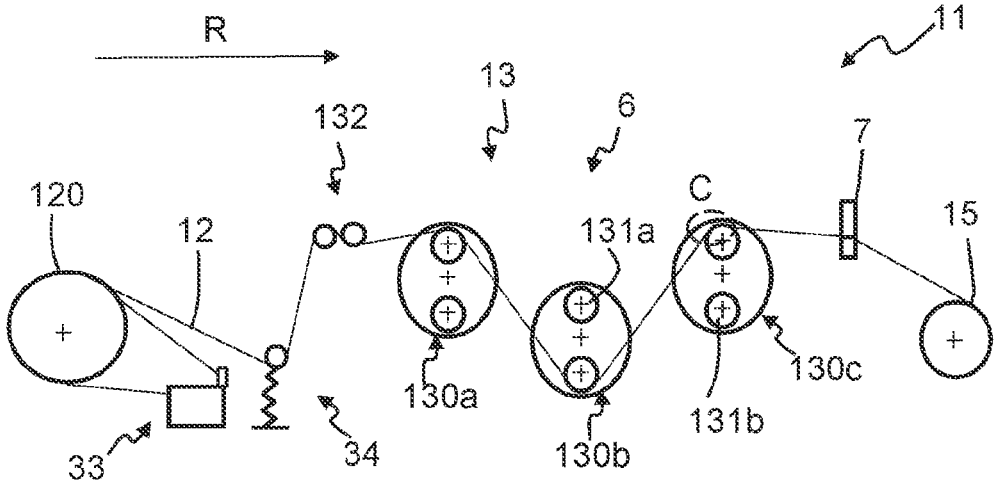
FIG. 9 is a side view of an apparatus according to a second embodiment of the invention.
Figure 10:
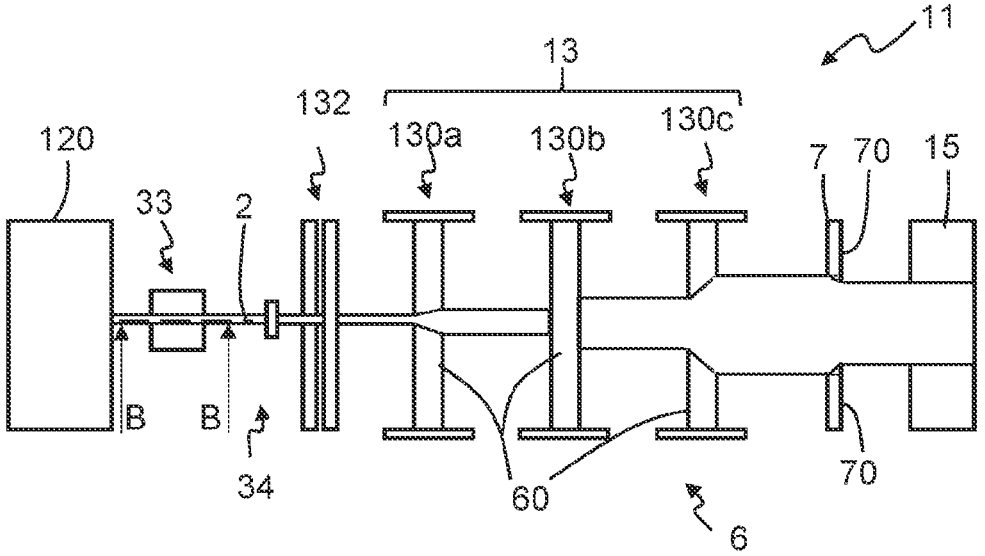
FIG. 10 is a plan view of the apparatus of FIG. 7.

Referring now to FIGS. 9 and 10, there is shown an apparatus 11 for spreading fibres according to a second embodiment of the invention, wherein like references (identified by a preceding '1') depict like features which will not be described herein further. The apparatus differs from the apparatus shown in FIGS. 1 and 2 in that it includes contact elements 6 and an accumulator 7 but does not include a fluid flow apparatus.

The fibre bundle 12 comprises plural continuous glass fibres held together by a binder resin.

The tensioning apparatus 13 differs from the tensioning apparatus 3 of the embodiment shown in FIGS. 1 and 2 in that it does not comprise a fluid flow apparatus 4. Furthermore, the apparatus 11 also includes a binder breaker 33 and a tensioner 34.

Figure 11:
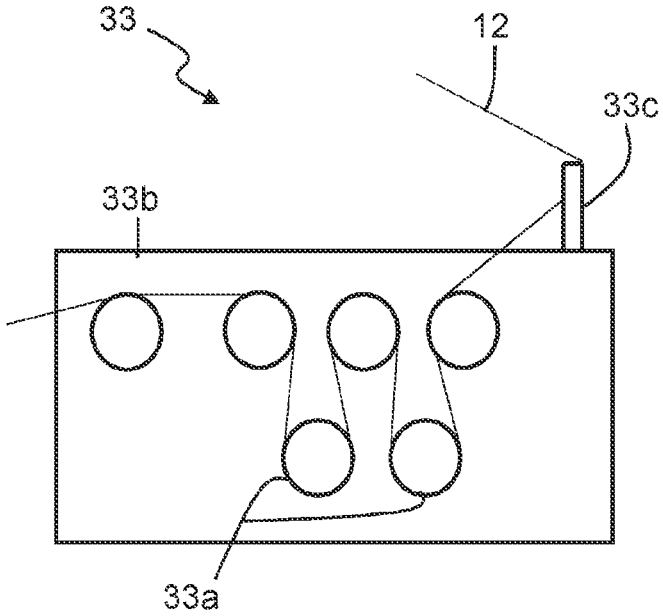
FIG. 11 is a sectional side view taken along the plane indicated by B-B in FIG. 9.
Figure 12:
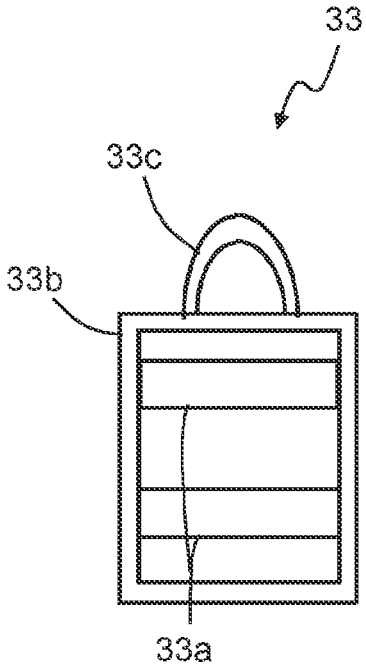
FIG. 12 is an end view of the component shown in FIG. 10.

The binder breaker 33, shown in FIGS. 11 and 12, includes a series of tension rolls 33*a* attached at their free ends to a housing 33*b*. The tension rolls 33*a* are formed from aluminium and are coated with PTFE in order to prevent damage to fibre bundle 12 as it is passed thereover. The tension rolls 33*a* are freely rotatable about their rotational axis and are arranged such that the fibre bundle 12 follows a tortuous path over and under successive tension rolls 33*a*. The binder breaker 33 further includes an orienting loop 33*c* which has a smooth and rounded inner surface and is located on an outer surface of the housing 33*b*.

The tensioner 34 includes a hook or roll connected to a spring configured to bias the fibre bundle 2 in a direction which is generally orthogonal to its running direction R.

The accumulator 7 includes a beam with guides 70 projecting orthogonally from its major surface, where the distance between the guides provides a constriction of a known width (transverse to the running direction R of the fibre bundle 2).

The accumulator 7 is located downstream of the tensioning apparatus 13 and upstream of the take up reel 15. The tensioner 34 is located upstream of the tensioning creels 130*a*, 130*b*, 130*c* and downstream of the supply bobbin 120. The binder breaker 33 is located upstream of the tensioner 34 and downstream of the supply bobbin 120.

The contact elements 6 comprise microfibre fabric 60. The microfibre fabric 60 is located on and around the outer surfaces of each of the tensioning rollers 131*a*, 131*b*. In an embodiment each of the rollers 131*a*, 131*b* (being those supported on each of the creels 130*a*, 130*b*, 130*c*) are provided with microfibre fabric 60. In other, albeit less preferred embodiments, at least some of the rollers 131*a*, 131*b* on one or more creels 130*a*, 130*b*, 130*c* will be provided with microfiber fabric 60.

Figure 13:
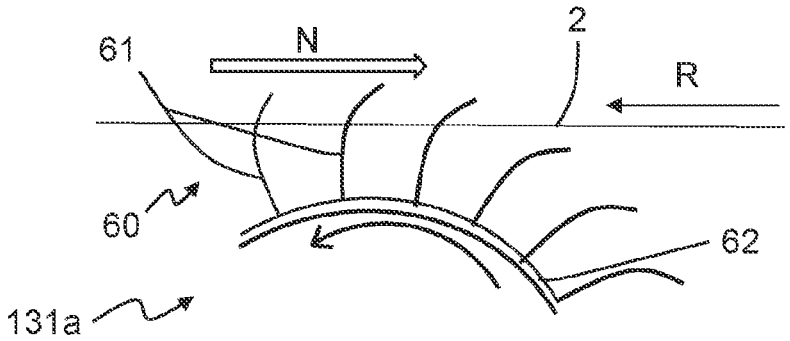
FIG. 13 is a partial sectional view of FIG. 8 taken from the area C.
Figure 14:
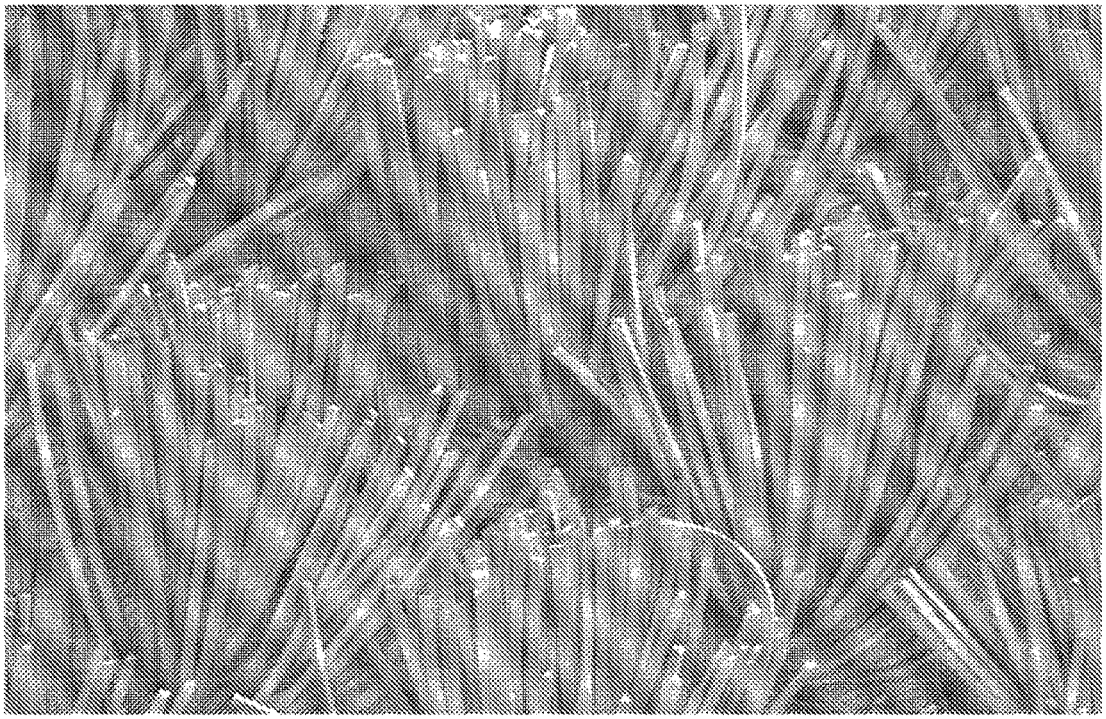
FIG. 14 is an SEM micrograph of the microfibre fabric shown in FIG. 8.

As shown in FIG. 13, the microfibre fabric 60 comprises a multitude of protruding fibres 61 which project generally orthogonally from the main surface 62 of the microfibre fabric 60. The protruding fibres 61 are generally oriented in a similar direction, referred to as the nap of the microfibre fabric (shown in FIG. 11 by arrow N). The microfibre fabric 60 is oriented on each of the tensioning rollers 131*a*, 131*b* such that its nap is facing a direction opposite to the running direction R of the fibre bundle 12. An image of the microfibre fabric 60 is shown in FIG. 14 where the protruding fibres 61 protrude from a main surface 62 by approximately 1 mm. In this embodiment the protruding fibres 61 are grouped together in plural bundles although one skilled in the art will appreciate that this need not be the case.

The apparatus 11 is prepared for use by feeding a free end of the fibre bundle 12 from the supply bobbin 120 through the orienting loop 33*c* and along the tortuous path between the tension rolls 33*a* of the binder breaker 33, back around the supply bobbin 120 and then under the hook or roll of the tensioner 34, over the first creel 130*a*, under the second creel 130*b*, over the third creel 130*c*, through the accumulator 7 and onto the take up reel 15 to which the free end of the fibre bundle 12 is attached.

In use, the fibre bundle 12 is drawn through the apparatus 11 in a running direction R via motor driven rotation of the take up reel 15 (as described above), whilst the fibre bundle 2 is simultaneously supplied from the supply bobbin 120 via motor (not shown) driven rotation thereof. All three creels 130*a*, 130*b*, 130*c* are rotationally driven by a motor (not shown). The first and third creels 130*a*, 130*c* are driven in a different (e.g. a clockwise) direction to the second creel 130*b* (e.g. which is driven in an anticlockwise direction). The tensioning rollers 131*a*, 131*b*, which may freely rotate about their rotational axes, intermittently contact the fibre bundle 12 in the manner described above. Without wishing to be bound by any theory we have found that it is particularly advantageous that the microfibre fabric 60, located around the tensioning rollers 131*a*, 131*b*, moves in the same direction as the running direction R of the fibre bundle 12 because this relatively reduces damage to the filament fibres within the fibre bundle 12 (compared to movement opposed to the running direction R of the fibre bundle 12).

The intermittently increased and decreased tension generated in the fibre bundle 12 by the tensioning apparatus 13, spreads the fibre bundle 12 as described above in relation to the embodiment shown in FIGS. 1 and 2. In addition, the protruding fibres 61 of the microfibre fabric 60 act to further spread the fibre bundle 12.

Passage of the fibre bundle 12 through the binder breaker 33 advantageously breaks (or at least begins to break) the binder which initially binds the individual fibres of the fibre bundle 12 together. Additionally, passage through the binder breaker 33 provides an additional tensioning of the fibre bundle 12. The tensioner 34 enhances and/or maintains tension in the fibre bundle 12. The tensioner 34 may maintain a minimum level of tension in the fibre bundle 12. Without wishing to be bound by any particular theory it is believed that breaking the binder (or beginning to break the binder) via the above-described mechanical system produces a fibre bundle 12 having filament fibres with improved (e.g. less reduced) physical and/or mechanical properties compared to fibre bundles 12 in which the binder is broken via pyrolysis. Post-pyrolysis fibres are commonly more fragile and susceptible to breaking. Furthermore, the above-described mechanically generated breaking of the binder does not negatively impact the environment, in contrast to the breaking of the binder through the use of solvents, which are detrimental to the environment.

Figure 15:
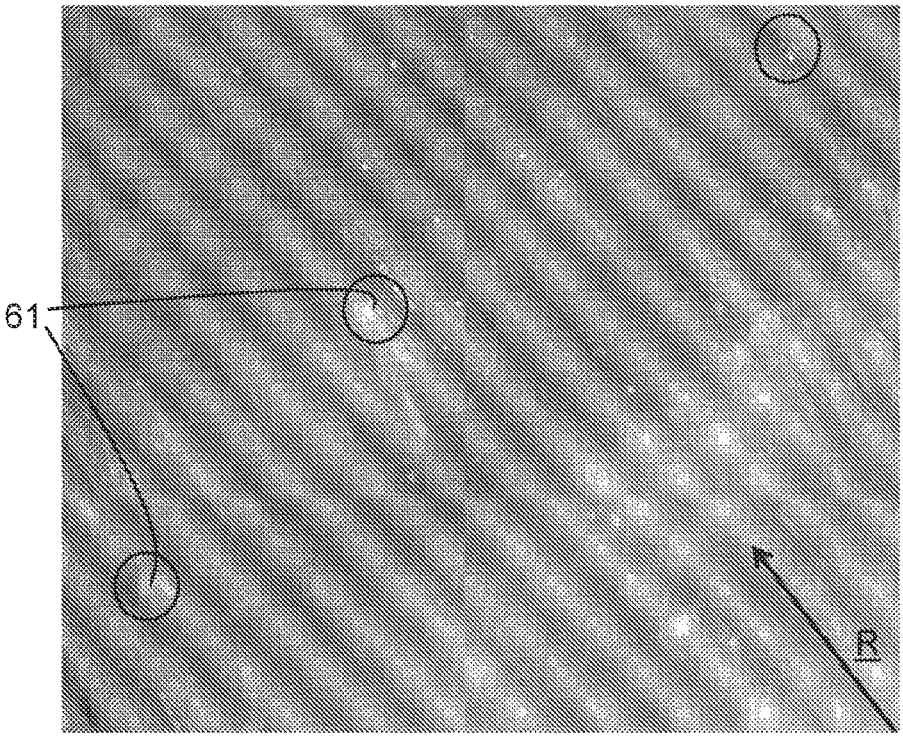
FIG. 15 is a photograph of a fibre bundle running over a micro-fibre fabric.

Without wishing to be bound by any particular theory it is believed that the protruding fibres 61 of the microfibre fabric 60 press against, and in some cases through, the fibre bundle 12 as it runs thereover (as shown in FIG. 15). In this way the protruding fibres 61 of the microfibre fabric 60 advantageously separate adjacent fibres of the fibre bundle 12 and consequently spread, e.g. further spread, said fibre bundle 12. Without wishing to be bound by any theory we believe that orientation of the nap N of the microfibre fabric 60 in a direction opposite to the running direction R of the fibre bundle 12 at least partially enhances the effect of the microfibre fabric 60 thereagainst.

The fibre bundle 12, which may be in an overly spread state (i.e. spread beyond a desired level of spread—for example beyond an ideal monolayer), passes through the constriction of the accumulator 7 which guides the fibre bundle 12 into a reduced or desired spread width $W_b$. The spread fibre bundle 12 is then collected on the take up roller 15, preferably with a paper release sheet (not shown) thereunder. The accumulator 7 may act to mitigate gaps between adjacent glass fibres.

Test Results

Multiple fibre bundles 12 of glass fibres each having a diameter of 24 μm, bound by a binder of epoxy resin at 0.5% w/w, were spread using the above-described apparatus 11 and method. The take up reel 15 was driven to rotate at an angular velocity of 3 rpm, whilst the first, second and third tensioning creels 130*a*, 130*b*, 130*c* were, respectively, driven to rotate at angular velocities of 70, 40 and 80 rpm.

Figure 16:
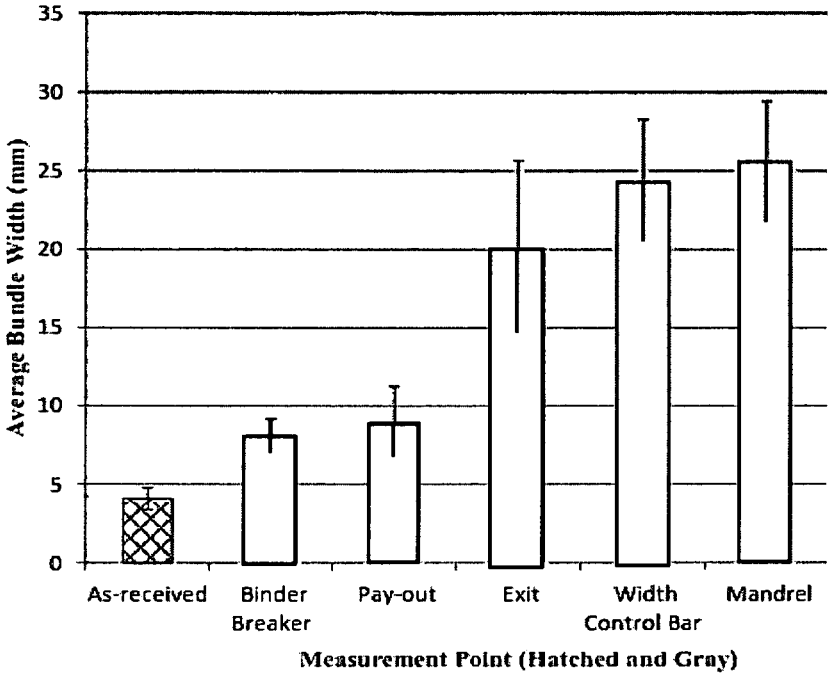
FIG. 16 is a graph of results of fibre spreading.

Averaged results from processing of the multiple fibre bundles 12 revealed that the fibre bundles 12 had an initial width $W_a$ of 4.09 mm, and a final spread width $W_b$ of 25.54 mm after running through the accumulator 7 and being collected on the take up reel 15. The spread width has a ratio to the initial width of 6.24:1. However, due to the presence of binder and the physical condition of the fibre bundle the bundles to be spread are not an idealised fibre bundle with each fibre close-packed with adjacent fibres. Indeed, each fibre had a diameter of 24 μm which lead to a ratio of average spread thickness Tb to the diameter of individual filament fibres of less than 2:1, meaning that the spread fibre bundle was at or approaching an idealised 'monolayer'. The results are shown in FIG. 16.

In a comparative test, where no microfiber was provided on the tensioning creels the maximum fibre spread was about 3 times, clearly demonstrating the efficacy of the microfibers.

Tensile Testing

Fibre bundle 12 spread by the above described apparatus 11 was cut to form 30 samples each of 50 mm length. Additionally, fibre bundle 12 as supplied (i.e. without being spread) was cut to firm samples of 500 length each. Each sample was then individually tested to failure at room temperature using an Instron 5566 tensile testing machine with a crosshead speed of 0.2 mm/min.

Result: The average peak load for non-spread fibre bundle 12 was found to be 984 N, whilst the average peak load for the spread fibre bundle 12 was found to be 878 N. The spread fibre bundle 12 therefore demonstrates a reduced tensile strength relative to non-spread fibre bundle 12, with the difference being on average 106 N or a decrease of 12%. The difference in tensile strength between the spread and non-spread fibre bundle 12 was therefore found to be negligible. Without wishing to be bound by any particular theory it is believed that the non-spread fibre bundle 12 has a relatively higher tensile strength at least in part due to twisting and tangling within the non-spread fibre bundle 12 (which are untwisted and/or untangled during spreading). When a fibre of a non-spread fibre bundle 12 breaks the free, broken ends may become entangled amongst adjacent twisted fibres thereby at least partially preventing retraction of said broken ends from the non-spread fibre bundle 12. Consequently, the broken thread of the non-spread fibre bundle 12 may continue to provide a partial resistance against a tensile load. In contrast, a broken fibre in a spread fibre bundle 12 has a substantially reduced probability of entanglement amongst adjacent fibres and consequently the broken fibre may not provide a partial resistance against a tensile load. Consequently, it has been found that spreading fibre bundle according to the invention results in spread fibre bundle 12 with minimal damage and reduced mechanical properties.

As will be appreciated, features of each of the above embodiments may be combined within a single apparatus for spreading fibres. For example, it is quite conceivable that any of the above-described features and/or the following features may be included in or with the first embodiment of the present invention: an accumulator 7, contact elements 6, a binder breaker 33 and/or a tensioner 34.

It will be appreciated by those skilled in the art that several variations to the aforementioned embodiments are envisaged without departing from the scope of the invention. For example, although a vacuum source (e.g. a source of negative pressure) has been described this need not be the case and the fluid flow apparatus 4 may additionally or alternatively comprise one or more sources of positive pressure. Additionally or alternatively, although the fluid is described as air in the above embodiments this need not be the case, and additionally or alternatively the fluid may be water or any other suitable fluid.

Additionally or alternatively, the tensioning apparatus 3, 13 may comprise more than three tensioning creels 30*a*, 30*b*, 30*c*, 130*a*, 130*b*, 130*c*, for example four, five, six, seven, or more tensioning creels. Where more than three tensioning creels are provided, some, none or all of the additional tensioning creels may be rotationally driven by a motor. Additionally or alternatively, each of the tensioning creels 30*a*, 30*b*, 30*c*, 130*a*, 130*b*, 130*c* may comprise only one tensioning roller 31*a*, 31*b*, 131*a*, 131*b* or may comprise more than two tensioning rollers 31*a*, 31*b*, 131*a*, 131*b* (for example, as shown in FIG. 8). Where more than two tensioning rollers 31*a*, 31*b*, 131*a*, 131*b* are provided on one, some or all of the tensioning creels 30*a*, 30*b*, 30*c*, 130*a*, 130*b*, 130*c* the tensioning rollers 31*a*, 31*b*, 131*a*, 131*b* may be arranged in any suitable orientation about the rotational axis of each tensioning creel 30*a*, 30*b*, 30*c*, 130*a*, 130*b*, 130*c*. Additionally or alternatively, the tensioning rollers 31*a*, 31*b*, 131*a*, 131*b* need not be formed from acetal but may instead by formed from any suitable substance, for example a plastic or a metal, or a metal or other material coated with a plastic or any other suitable coating.

Additionally or alternatively, although the slots 47 of the fluid flow apparatus 4 are described above as vertical they need not be and may instead have any other suitable orientation. Additionally or alternatively, the slots 47 may define a curve or arc, at least in one or more part of their length. Additionally or alternatively, the retention baton or member 46 may be biased by a biasing means, e.g. a spring, toward or away from the fluid flow outlet 45 within the slots 47. Additionally or alternatively, the retention baton or member 46 may be driven or drivable, e.g. by an actuator, toward or away from the fluid flow outlet 45 within the slots 47.

Additionally or alternatively, although only one fluid flow apparatus 4 is described in relation to the embodiment shown in FIGS. 1 and 2 this need not be the case and instead any suitable number of fluid flow apparatus 4 may be provided. Furthermore, where more than one fluid flow apparatus 4 is provided, the additional fluid flow apparatus may be provided at the same or a similar location in the apparatus 1 or may be located in alternative locations, for example upstream of the tensioning apparatus 3.

Additionally or alternatively, although only one accumulator is shown in the embodiment shown in FIGS. 8 and 9 this need not be the case and instead any suitable number of accumulators may be provided, for example 2, 3, 4 or more. Where more than one accumulator is provided the apparatus 11 may further include a tensioning arm located between each accumulator, where the tensioning arm may be configured to maintain or retain a tension in the fibre bundle 12.

Additionally or alternatively, the apparatus 1, 11 may include one or more measuring apparatus, which may be located downstream of the tensioning apparatus and/or downstream of the fluid flow apparatus (where provided) or at any suitable location. The measuring apparatus may be configured to measure one or more parameters of the fibre bundle 2, 12, for example the width or thickness thereof.

Additionally or alternatively, although the fibre bundle 2 described above in relation to the embodiments shown in FIGS. 1 and 2 is described as including plural continuous carbon fibres this need not be the case and instead the fibre bundle 2 may include any suitable type of fibres, for example, glass fibres, ceramic fibres, aromatic polyamide fibres or any combination thereof (with or without carbon fibres). Additionally or alternatively, although the fibre bundle 12 described above in relation to the embodiments shown in FIGS. 8 and 9 is described as including plural continuous glass fibres this need not be the case and instead the fibre bundle 2 may include any suitable type of fibres, for example, carbon fibres, ceramic fibres, aromatic polyamide fibres or any combination thereof (with or without glass fibres).

It will also be appreciated by those skilled in the art that any number of combinations of the aforementioned features and/or those shown in the appended drawings provide clear advantages over the prior art and are therefore within the scope of the invention described herein.

The invention claimed is:

1. A method of spreading fibres, the method comprising providing a continuous fibre bundle having an initial width $W_a$ and causing the fibre bundle to run, in a running direction, through a tensioner and a contact member, the tensioner intermittently varying the tension in the fibre bundle and the contact member comprising a microfibre fabric arranged to contact the fibre bundle, whereby the width of the fibre bundle increases to a spread width $W_b$.

2. The method according to claim 1, wherein the microfibre fabric comprises a nap arranged in a direction opposite to the running direction of the fibre bundle.

3. The method according to claim 1, further comprising a binder breaker member configured to break or loosen binder in and/or on the fibre bundle.

4. The method according to claim 1, comprising restricting the fibre bundle width after the fibre bundle has run through the tensioner.

5. The method according to claim 1, wherein the fibre bundle comprises glass fibres.

6. The method according to claim 1, comprising causing or providing a ratio of spread width $W_b$ to the initial width $W_a$ of greater than 5:1.

7. The method according to claim 1, wherein the fibre bundle comprises plural filament fibres each having a diameter and the fibre bundle comprises an average spread thickness $T_b$, comprising causing or providing a ratio of the average spread thickness $T_b$ to the diameter of individual filament fibres of between about 4:1 and 1:1.

8. The method according to claim 1, comprising translating the tensioner in the running direction of the fibre bundle.

9. An apparatus for spreading fibres, the apparatus comprising a tensioner and a contact member, the tensioner being arranged to intermittently vary the tension in a continuous fibre bundle running therethrough and the contact member comprising a microfibre fabric arranged to contact the fibre bundle thereby to increase the width of the fibre bundle from an initial width $W_a$ to a spread width $W_b$.

10. The apparatus according to claim 9, wherein the microfibre fabric comprises a nap arranged in a direction opposite to the running direction of the fibre bundle.

11. The apparatus according to claim 9, wherein the tensioner comprises one or more tensioning rollers, and the microfibre fabric is located on and/or around the one or more of or all of said one or more tensioning rollers.

12. The apparatus according to claim 9, further comprising a binder breaker member configured to break or loosen a binder in and/or on the fibre bundle.

13. The apparatus according to claim 12, wherein the binder breaker member comprises a tortuous pathway through which the fibre bundle runs or is configured to run.

14. The apparatus according to claim 9, wherein the apparatus comprises an accumulator configured to restrict the fibre bundle width.

15. The apparatus according to claim 14, wherein the accumulator is located downstream of the tensioner.

16. The apparatus according to claim 9, wherein the spread width $W_b$ has a ratio to the initial width $W_a$ of greater than 5:1.

17. The apparatus according to claim 9, wherein the fibre bundle comprises plural continuous filament fibres each having a diameter and the fibre bundle comprises an average spread thickness $T_b$ and wherein the average spread thickness $T_b$ has a ratio to the diameter of individual filament fibres of between about 4:1 and 1:1.

18. The apparatus according to claim 9, wherein said tensioner is arranged to translate, in use, in the running direction of the fibre bundle running therethrough.

19. The apparatus according to claim 9, wherein said tensioner comprises one or more tensioning rollers which are moving or are movable in order to intermittently increase and decrease tension in the fibre bundle.

20. The apparatus according to claim 19, wherein one or more or all of said one or more tensioning rollers rotates or is rotatable about its or their central axis or axes.

* * * * *